US011268529B2

(12) United States Patent
Huang et al.

(10) Patent No.: US 11,268,529 B2
(45) Date of Patent: Mar. 8, 2022

(54) ELECTRIC AIR PUMP SYSTEM

(71) Applicant: BESTWAY INFLATABLES & MATERIAL CORP., Shanghai (CN)

(72) Inventors: Shuiyong Huang, Shanghai (CN); Wanbin Qiu, Shanghai (CN); Ruoxun Yin, Shanghai (CN); Qinliang Tan, Shanghai (CN); Yalan Chen, Shanghai (CN)

(73) Assignee: BESTWAY INFLATABLES & MATERIAL CORP.

( * ) Notice: Subject to any disclaimer, the term of this patent is extended or adjusted under 35 U.S.C. 154(b) by 129 days.

(21) Appl. No.: 16/370,647

(22) Filed: Mar. 29, 2019

(65) Prior Publication Data

US 2019/0301476 A1 Oct. 3, 2019

(30) Foreign Application Priority Data

Mar. 30, 2018 (CN) ..... 201820444453.7

(51) Int. Cl.

| | |
|---|---|
| ***F04D 25/16*** | (2006.01) |
| ***F04D 25/06*** | (2006.01) |
| ***F04D 27/00*** | (2006.01) |
| ***F04D 25/08*** | (2006.01) |

(52) U.S. Cl.

CPC ..... *F04D 25/16* (2013.01); *F04D 25/068* (2013.01); *F04D 25/0666* (2013.01); *F04D 25/08* (2013.01); *F04D 27/008* (2013.01)

(58) Field of Classification Search

CPC ..... F04D 25/16; F04D 25/166; F04D 29/503; F04D 27/005; F04D 25/0666; F04D 27/008; F04D 27/0269; F04D 25/068; F04D 25/08; F04D 29/46; F04D 27/002; F04D 29/50; F04D 25/10; F04D 25/12; F04D 25/14; A47C 27/081–27/084

USPC ..... 417/63

See application file for complete search history.

(56) References Cited

U.S. PATENT DOCUMENTS

| | | | | |
|---|---|---|---|---|
| 4,993,920 | A * | 2/1991 | Harkleroad | A47C 27/082 417/44.2 |
| 9,879,682 | B1 * | 1/2018 | Beliveau | F04D 25/166 |
| 2015/0152860 | A1 * | 6/2015 | Darak | F04D 27/004 417/12 |
| 2015/0316068 | A1 * | 11/2015 | Tsai | F04B 35/04 417/44.1 |

(Continued)

FOREIGN PATENT DOCUMENTS

CN 205779791 * 12/2016

*Primary Examiner* — Bryan M Lettman

(74) *Attorney, Agent, or Firm* — Dickinson Wright PLLC

(57) ABSTRACT

An electric air pump system includes a housing in fluid communication with an inflatable body, a first valve, a first air pump for inflating and deflating the inflatable body, a second air pump for inflating the inflatable body, an air pressure sensor configured to detect the inner pressure of the inflatable body, and first and second prompting devices. The system also includes a control device electrically coupled to the first and second air pumps, the air pressure sensor, and the first and second prompting devices. The first prompting device outputs a first indication signal when the inner pressure is less than or equal to a first air pressure threshold and the second prompting device outputs a second indication signal when the second air pump inflates the inflatable body.

19 Claims, 11 Drawing Sheets

(56) References Cited

U.S. PATENT DOCUMENTS

2017/0280884 A1* 10/2017 Liu ..... A47C 27/083

* cited by examiner

ELECTRIC AIR PUMP SYSTEM

CROSS-REFERENCE TO RELATED APPLICATIONS

This application claims the priority of Chinese Patent Application No. 201820444453.7, filed Mar. 30, 2018, which is incorporated herein by reference in its entirety.

FIELD

The present disclosure relates to an air pump system and, more particularly, to an electric air pump system for use with an inflatable body.

BACKGROUND

Common inflatable bodies, such as inflatable beds, inflatable mattresses, inflatable boats and inflatable toys and the like, have a variety of advantages, such as being light weight, easy to fold and comfortable. An air pump is often used in conjunction with the inflatable body for inflation and deflation of the inflatable body. When performing inflation of the inflatable body, whether the inner pressure of the inflatable body arrives at an appropriate air pressure value will influence a user's experience and the lifetime of the inflatable body. Taking an inflatable mattress as an example, if an air pressure in the inflatable mattress is insufficient, the inflatable mattress will offer poor support. If the inflatable mattress is over-inflated, it will exhibit expansion and deformation and can become damaged. As for existing inflatable bodies, the inner pressure of the inflatable body is detected by pressing the inflatable body during or after inflation, without a pressure meter. However, such a detection method is neither easy for operation, nor accurate. Therefore, it is difficult for a user to determine the inner pressure of the inflatable body. There is a need to provide an electric air pump system which can provide easy and accurate measurement of the inner pressure of the inflatable body, and which can perform automatic inflation of the inflatable body to conform the inner pressure to an appropriate value when the inner pressure of the inflatable body changes.

SUMMARY

This section provides a general summary of the present disclosure and is not a comprehensive disclosure of its full scope or all of its features, aspects, and objectives.

Disclosed herein are exemplary implementations of an electric air pump system. One exemplary system includes a housing defining a receiving cavity. The housing can have an opening and a first vent in fluid communication with an inflatable body. The system can include a first valve for opening and closing the first vent. The system can include a first air pump for inflating and deflating the inflatable body, wherein the first air pump is configured to inflate the inflatable body to a first air pressure threshold. The system can include a second air pump for inflating the inflatable body after the inflatable body is inflated by the first air pump, wherein the second air pump is configured to inflate the inflatable body when an inner pressure of the inflatable body is less than or equal to a second air pressure threshold and greater than or equal to a third air pressure threshold. The system can have an air pressure sensor in fluid communication with the inflatable body and configured to detect the inner pressure, a first prompting device, and a second prompting device. The system can also have a control device electrically coupled to the first air pump, the second air pump, the air pressure sensor, and the first and second prompting devices. The first prompting device can be configured to output a first indication signal when the inner pressure is less than or equal to the first air pressure threshold and greater than the second air pressure threshold. The second prompting device is configured to output a second indication signal when the second air pump inflates the inflatable body.

Also disclosed is another exemplary electric air pump system that can include an inflatable body and an air pressure sensor in fluid communication with the inflatable body and configured to detect an air pressure within the inflatable body. The system can also include a first air pump for inflating and deflating the inflatable body and a second air pump for inflating the inflatable body. The system can further include a first prompting device and a second prompting device. The system can include a control device electrically coupled to the first air pump, the second air pump, the air pressure sensor, and the first and second prompting devices. The control device can be configured to activate the first air pump to inflate the inflatable body to a first air pressure threshold and deactivate the first air pump if either the first air pressure threshold is reached or the first air pressure threshold is not reached within a first period of time. The control device can also be configured to activate the second air pump to inflate the inflatable body to the first air pressure threshold when the air pressure is less than or equal to a second air pressure threshold and greater than or equal to a third air pressure threshold and deactivate the second air pump if either the first air pressure threshold is reached or the first air pressure threshold is not reached within a second period of time.

Also disclosed is another exemplary electric air pump system that can include an inflatable body, a first air pump configured to inflate the inflatable body to a first air pressure threshold, and a first prompting device configured to output a first signal when an inner air pressure of the inflatable body is greater than a second air pressure threshold. The system can also include a second air pump configured to inflate the inflatable body to the first air pressure threshold if the inner pressure is at or between the second air pressure threshold and a third air pressure threshold after the inflatable body has previously reached the first air pressure threshold. The system can also include a second prompting device configured to output a second signal when the second air pump inflates the inflatable body and a third prompting device configured to output a default signal. The system can include a control device coupled to at least the first air pump and the third prompting device and configured to turn off the first air pump and output the default signal if the first air pump does not inflate the inflatable body to the first air threshold within a period of time.

BRIEF DESCRIPTION OF THE DRAWINGS

The disclosure is best understood from the following detailed description when read in conjunction with the accompanying drawings. It is emphasized that, according to common practice, the various features of the drawings are not to-scale. On the contrary, the dimensions of the various features are arbitrarily expanded or reduced for clarity.

DETAILED DESCRIPTION

The following description is merely exemplary in nature and is not intended to limit the disclosure in its application or use. For purposes of clarity, the same reference numbers are used in the description and drawings to identify similar elements.

Although the electric air pump system described herein can be employed in various different ways and embodiments, a series of exemplary embodiments of the present disclosure are described below with reference to the drawings for illustration. It should be understood that the description regarding the exemplary embodiments should be considered as illustrative of the structure and the principles of operation for the electric air pump, but the present disclosure is not limited to the exemplary embodiments disclosed herein.

The present disclosure provides an electric air pump system that allows a user to determine the inner pressure of an inflatable body. The inflatable body can be an inflatable air mattress, or any other desired inflatable body.

Figure 1:
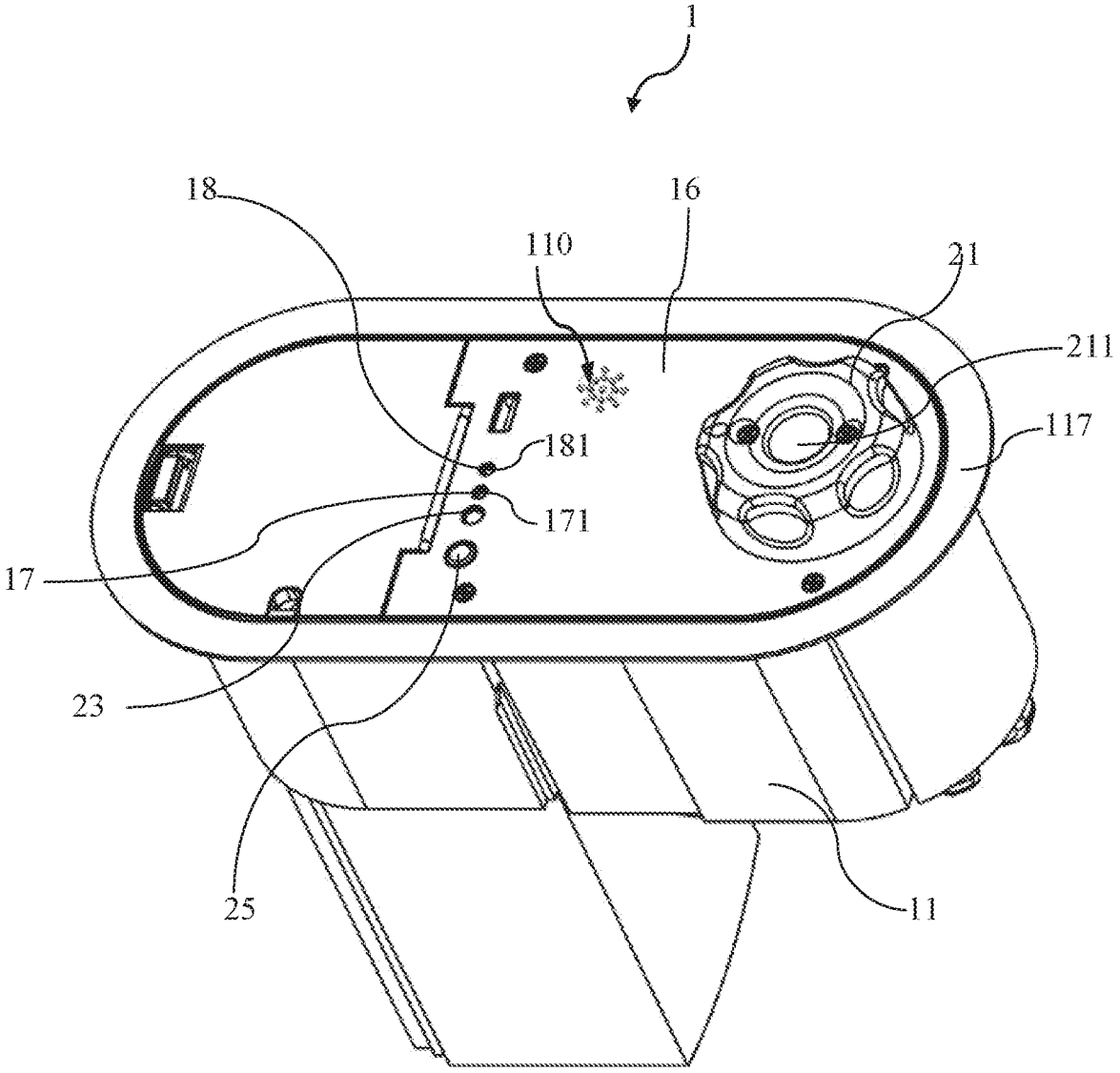
FIG. 1 is a perspective view of an electric air pump system, in accordance with aspects of the present disclosure.

As shown in FIG. 1, the present disclosure includes an electric air pump system 1. In general, as shown in FIGS. 1 and 2, the electric air pump system 1 includes a housing 11, a first valve 12, a first air pump 13, an air passage switch device 14, an air pressure sensor 24, a second air pump 15, a panel 16, a first prompting device 17, a second prompting device 18 and a control device 19, which will be described in further detail below.

Figure 2:
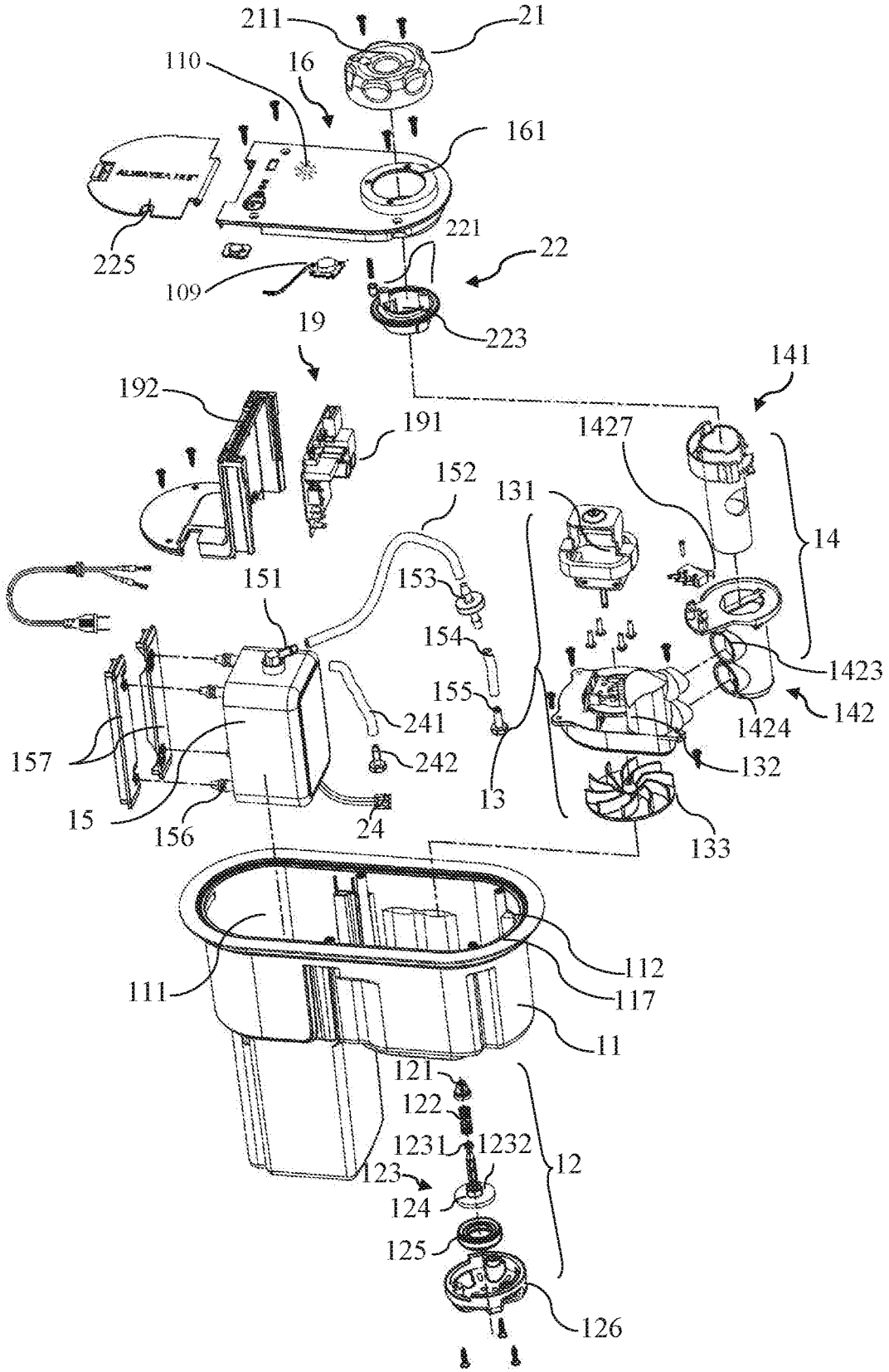
FIG. 2 is an exploded perspective view of the electric air pump system of FIG. 1, in accordance with aspects of the present disclosure.
Figure 3:
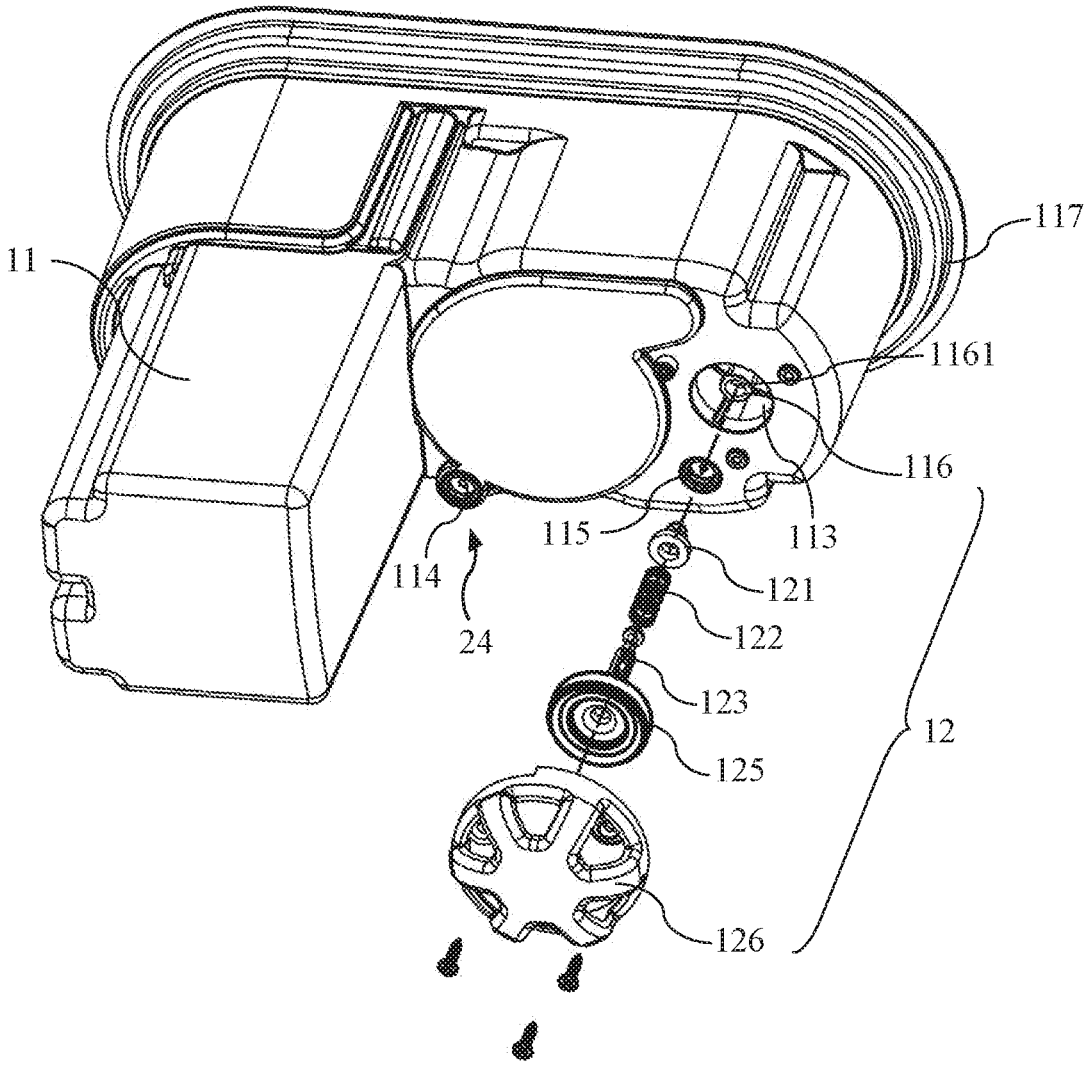
FIG. 3 is an exploded perspective view of the electric air pump system of FIG. 1 showing the housing and a first valve, in accordance with aspects of the present disclosure.

In particular, the housing 11 can include a receiving cavity 111, a housing opening 112 and a first vent 113, as shown in FIGS. 1-3. The housing 11 can further include a pressure detection vent 114, a supplementary air vent 115, a housing flange 117, or any other desirable openings. The housing flange 117 can be coupled to a wall of an inflatable body 20 (shown in FIGS. 4-6) and configured to mount the electric air pump system 1 to the inflatable body 20. The first air pump 13, the air passage switch device 14, the air pressure sensor 24, and the second air pump 15 can be located within the receiving cavity 111 and can be electrically coupled to the control device 19. The panel 16 can be coupled to the housing 11 and can cover at least a part of the housing opening 112. The panel 16 can further define a second vent 161 in fluid communication with the first vent 113 via the receiving cavity 111.

The electric air pump system 1 can further include a control switch 21 and a connection tube 22. The control switch 21 can be mounted to the second vent 161 and coupled to the connection tube 22 via the second vent 161. The control switch 21 can define a switch vent 211 in fluid communication with the outer space of the inflatable body 20 (i.e., atmosphere).

Figure 4:
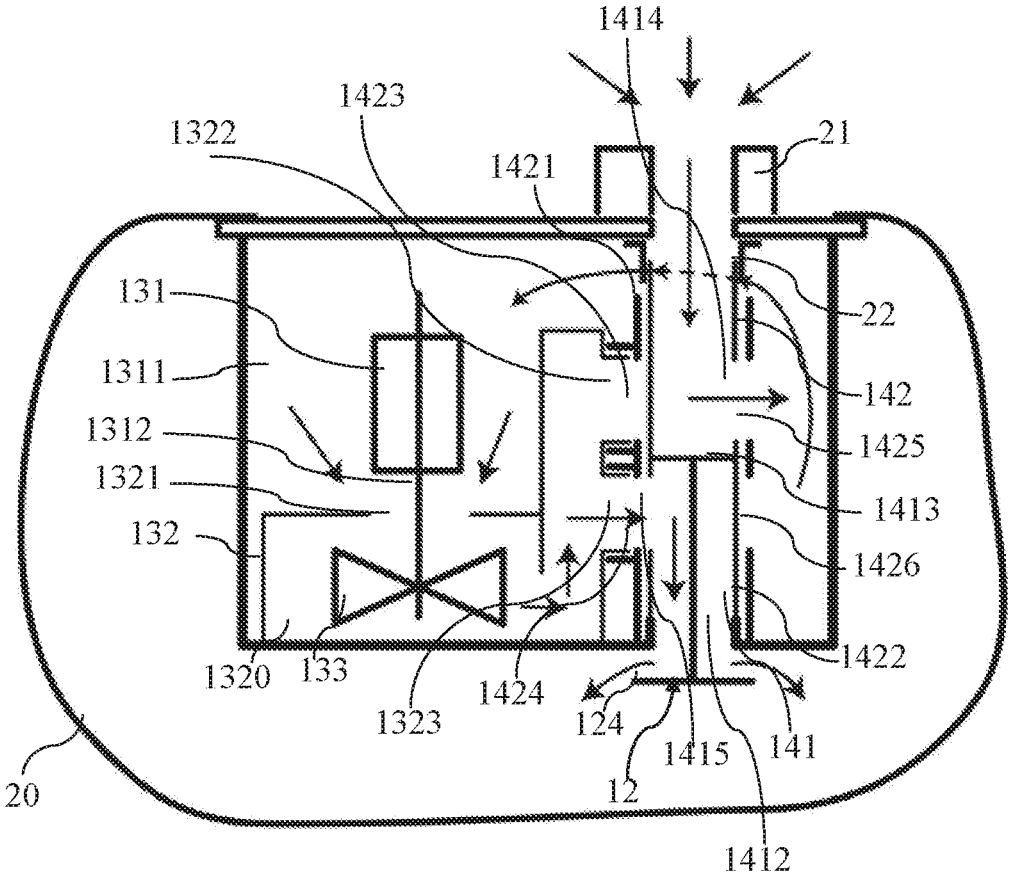
FIG. 4 is a schematic diagram showing the electric air pump system of FIG. 1 during inflation of an inflatable body, in accordance with aspects of the present disclosure.
Figure 5:
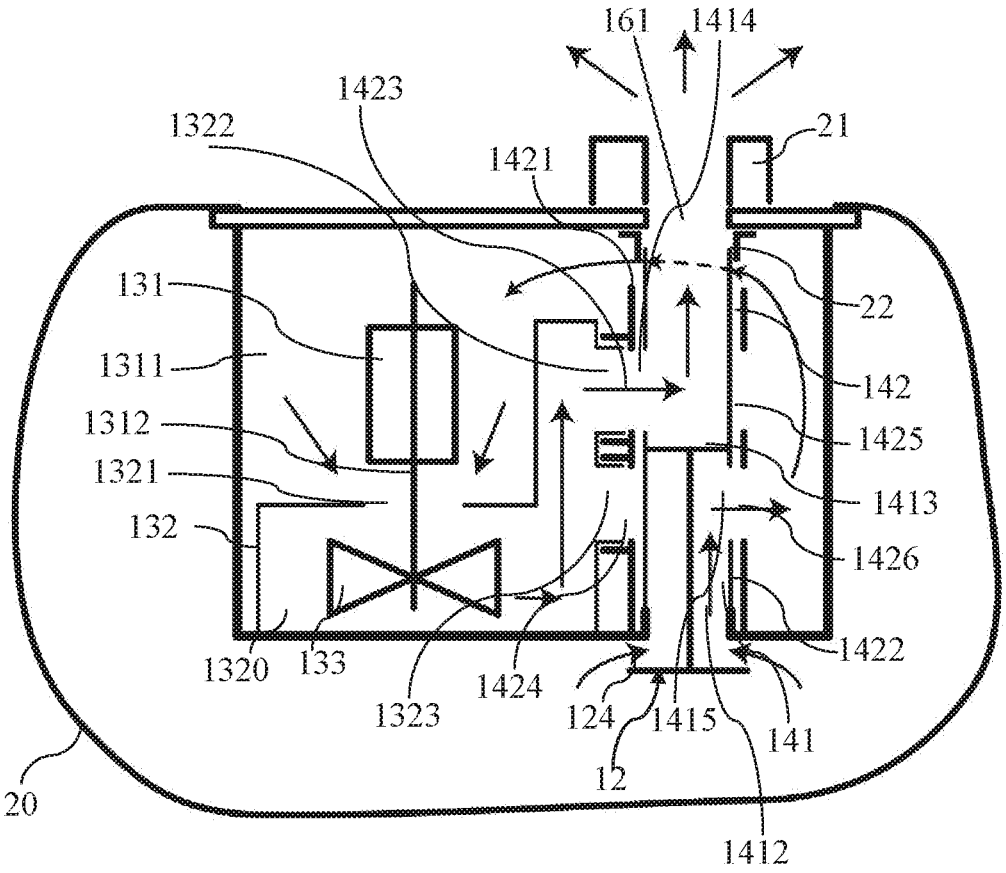
FIG. 5 is a schematic diagram showing the electric air pump system of FIG. 1 during deflation of an inflatable body, in accordance with aspects of the present disclosure.
Figure 6:
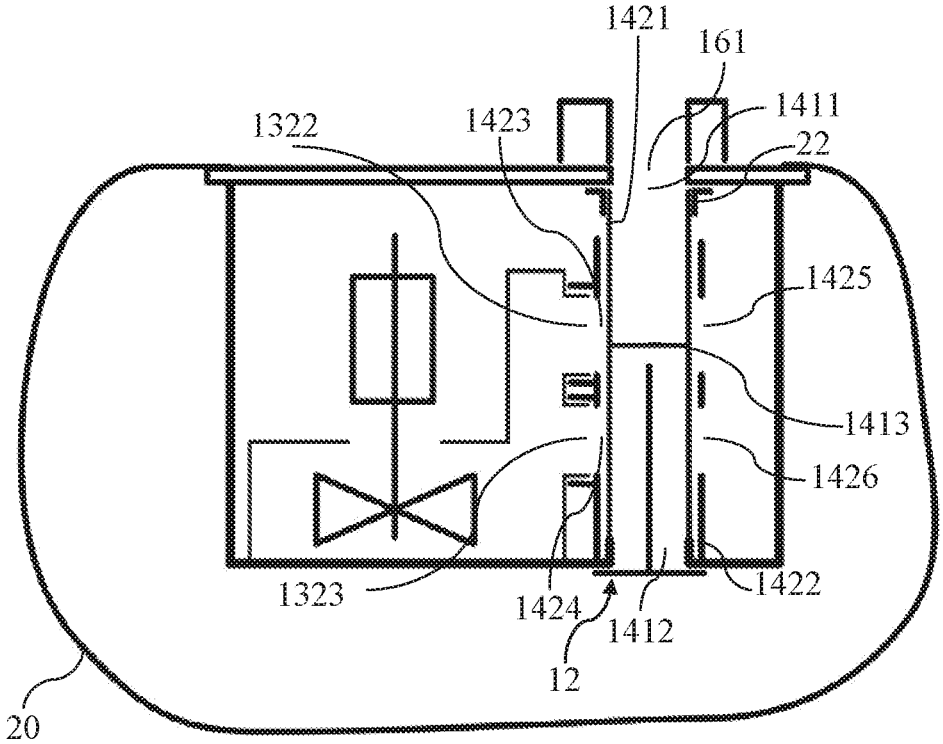
FIG. 6 is a schematic diagram showing the electric air pump system of FIG. 1 in neither an inflation, nor a deflation mode for an the inflatable body, in accordance with aspects of the present disclosure.
Figure 7:
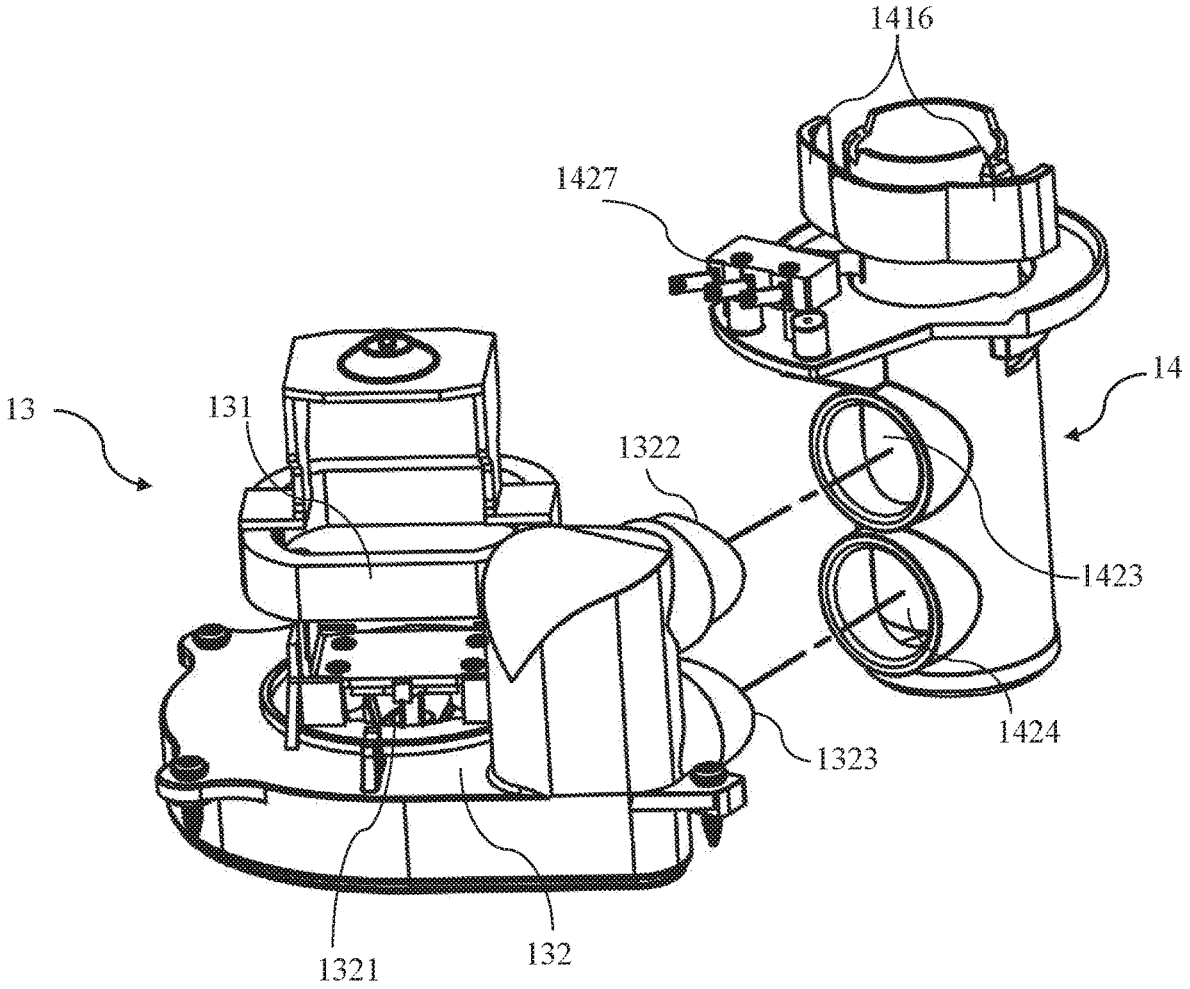
FIG. 7 is a partial exploded perspective view of the electric air pump system of FIG. 1 showing a first air pump and an air passage switch device, in accordance with aspects of the present disclosure.
Figure 8:
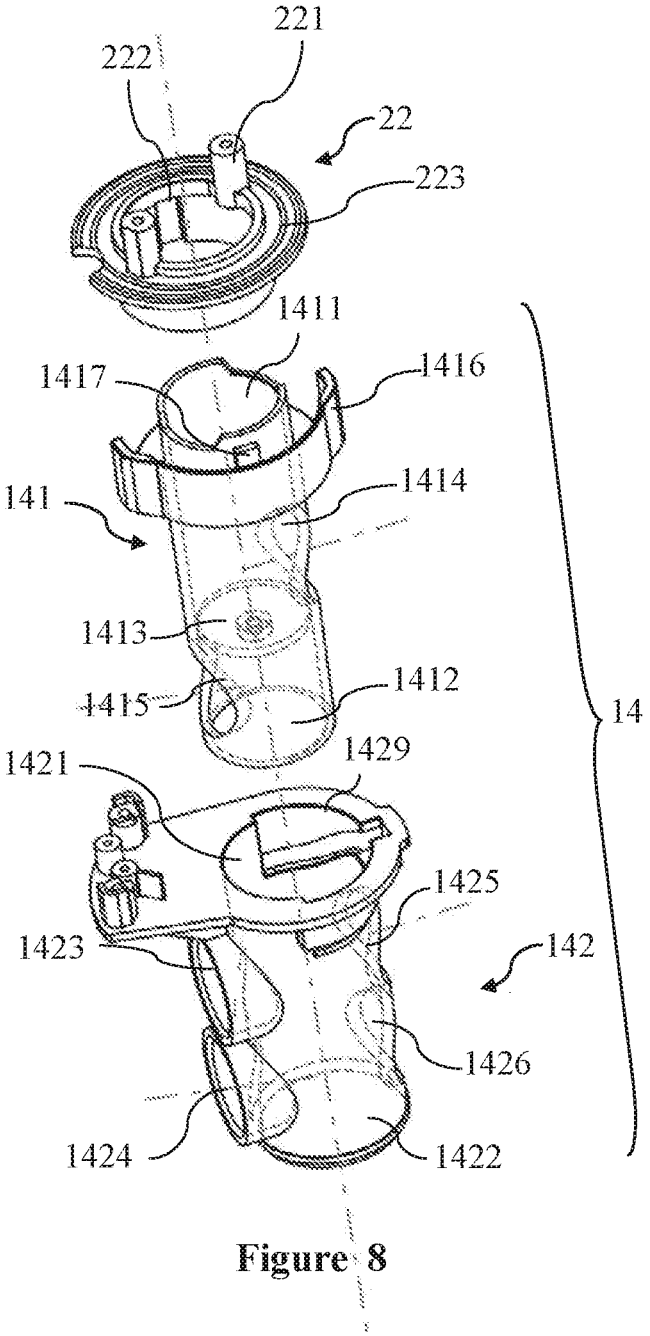
FIG. 8 is a partial exploded perspective view of the electric air pump system of FIG. 1 showing a connection tube and an air passage switch device which is switched to form the inflation air passage, in accordance with aspects of the present disclosure.
Figure 9:
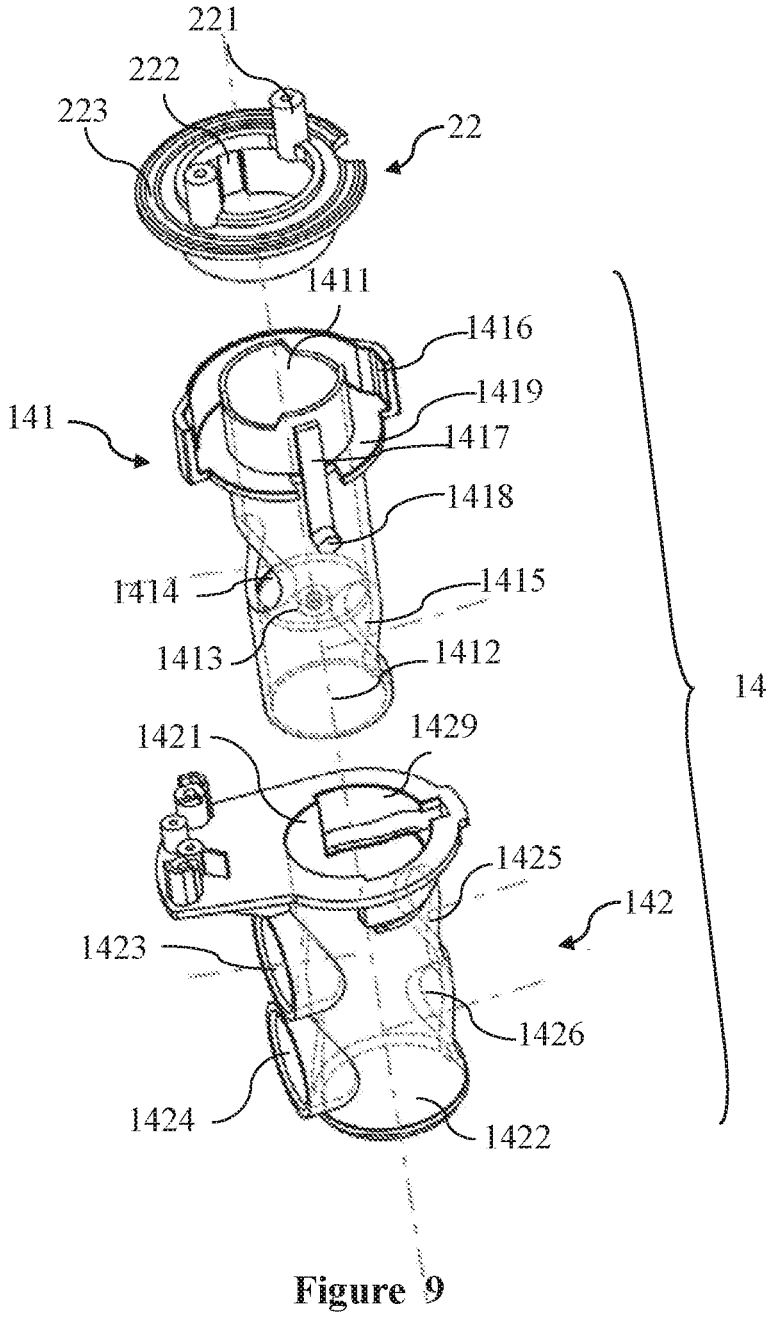
FIG. 9 is a partial exploded perspective view of the electric air pump system of FIG. 1 showing a connection tube and an air passage switch device which is switched to form the deflation air passage, in accordance with aspects of the present disclosure.

The first air pump 13 can be configured to inflate or deflate the inflatable body 20. The air passage switch device 14 can be coupled to the first air pump 13 and configured to selectively switch between two air passages: an inflation air passage and a deflation air passage (a third option being neither passage, i.e., closed). The air passage switch device 14 can further selectively control the first valve 12, such as a one-way valve, to selectively open or close the first vent 113. When the first vent 113 is opened by the first valve 12, it can be in fluid communication with an internal portion (which can also be called an internal cavity, an internal space or an interior) of the inflatable body 20, thereby allowing the fluid to flow through the first vent 113 and inflate or deflate the inflatable body 20, as shown in FIGS. 4 and 5. When the first vent 113 is closed by the first valve 12, the fluid communication between the first vent 113 and the internal portion of the inflatable body 20 can be blocked, thereby preventing fluid from flowing through the first vent 113, as shown in FIG. 6.

Figure 10:
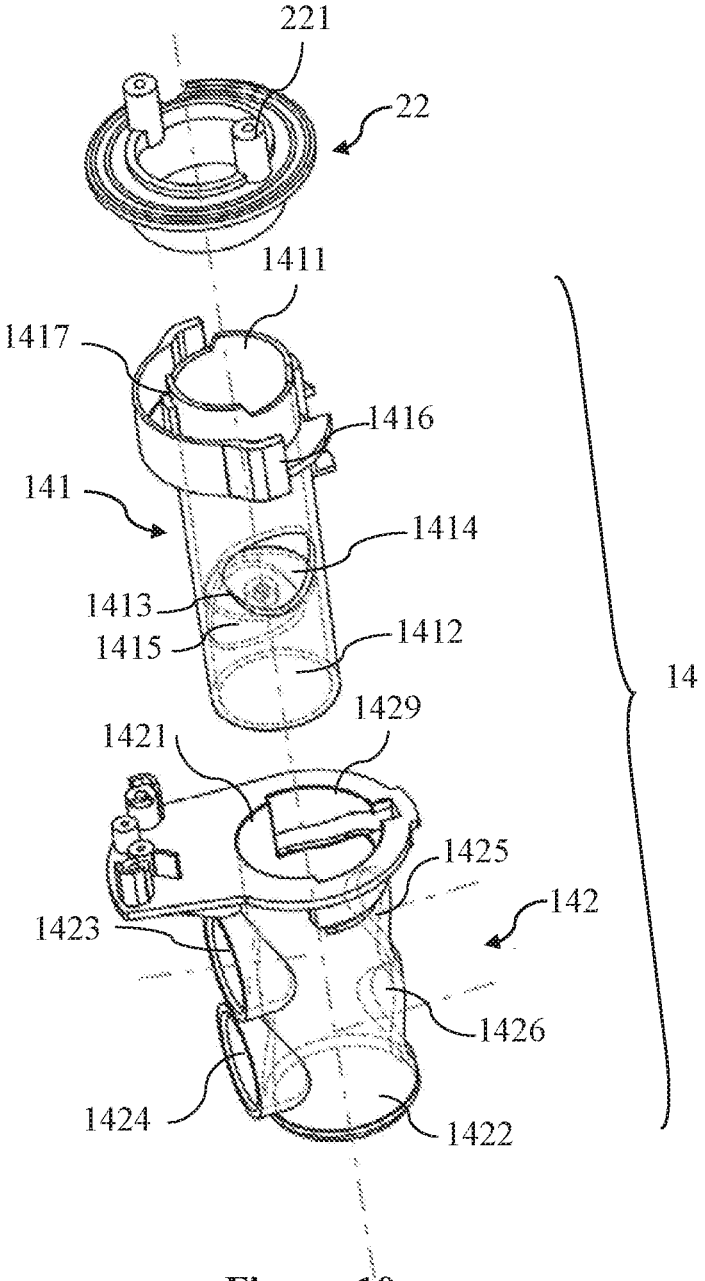
FIG. 10 is a partial exploded perspective view of the electric air pump system of FIG. 1 showing a connection tube and an air passage switch device which is switched to form a closed air passage, in accordance with aspects of the present disclosure.
Figure 11:
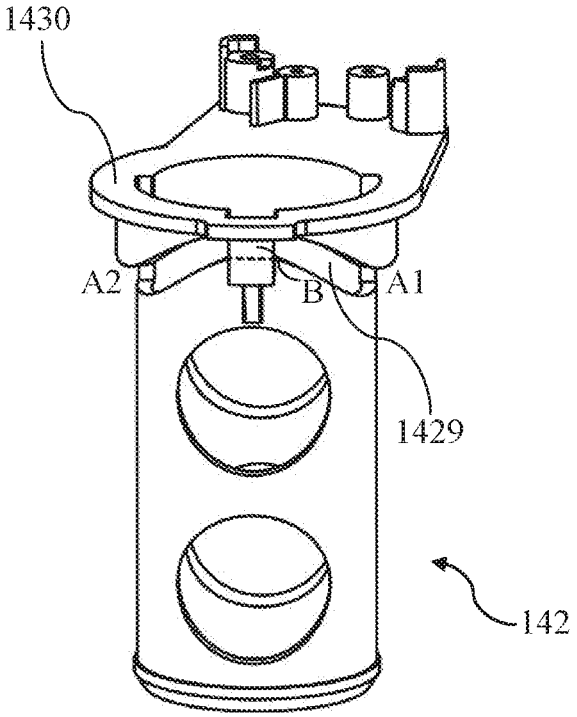
FIG. 11 is a perspective view of the outer tube of the air passage switch device of FIG. 7, in accordance with aspects of the present disclosure.
Figure 12:
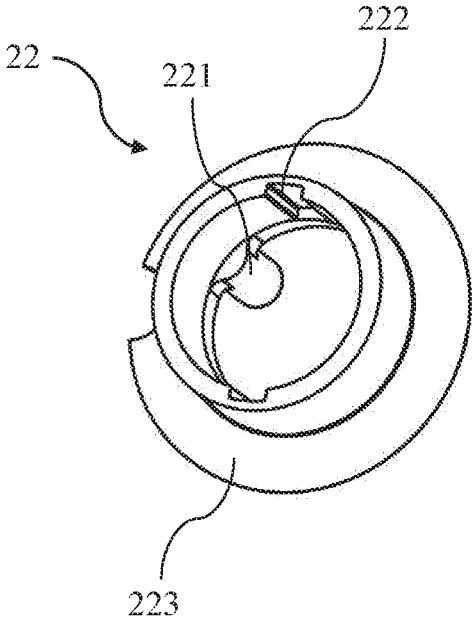
FIG. 12 is a perspective view of the connection tube of FIG. 9, in accordance with aspects of the present disclosure.

As shown in FIGS. 2, 4, and 7-10, the air passage switch device 14 may include a hollow inner tube 141 and an outer tube 142. The inner tube 141 can have a first inner tube opening 1411 and second inner tube opening 1412 at ends thereof. The first inner tube opening 1411 can be in fluid communication with the outer space of the inflatable body 20 via the connection tube 22. The second inner tube opening 1412 can be in fluid communication with the first vent 113. A first sliding block 1417 fitting with the connection tube 22, a second sliding block 1418 fitting with the outer tube 142 and an inner tube flange 1419 can be disposed on an outer portion of the inner tube 141. An arc sheet 1416 can be disposed on the edge of the upper surface of the inner tube flange 1419. A spacer 1413 can be disposed within the inner tube 141 to separate the inner space of the inner tube 141 into two parts that are not in communication with each other. The third inner tube opening 1414 and the fourth inner tube opening 1415 can be disposed on a wall of the inner tube 141 and at opposite sides of the spacer 1413, the opening directions of which are opposite to each other. The outer tube 142 can be sleeved with the inner tube 141 and can define a first outer tube opening 1421 and a second outer tube opening 1422 at ends thereof. The inner wall of the outer tube 142 can be positioned adjacent to the outer wall of the inner tube 141. The inner tube 141 can axially move or radially rotate within the outer tube 142. An outer tube flange 1430 can be disposed on the upper end of the outer tube 142 (as shown in FIG. 11). The lower end of the outer tube 142 can be coupled to the housing 11. The first vent 113 on the housing 11 can be disposed inside of the second outer tube opening 1422, as shown in FIGS. 2 and 3. A first outer tube inlet 1423 and a second outer tube inlet 1424 can be adjacent to each other, and a first outer tube outlet 1425 and a second outer tube outlet 1426 can respectively oppose the first outer tube inlet 1423 and the second outer tube inlet 1424, which are disposed on a wall of the outer tube 142. An arc-sliding slot 1429 with two ends (e.g., a first low position A1 and a second low position A2) lower than the middle part can be disposed on the wall of the outer tube 142 (as shown in FIG. 11). The arc-sliding slot 1429 can allow the second sliding block 1418 disposed on the inner tube 141 to slide therein.

Based on the above configuration, when the inner tube 141 is rotated to allow the second sliding block 1418 of the inner tube 141 to move to the first low position A1 on the arc sliding slot 1429 of the outer tube 142 (see FIGS. 8 and 11), the third inner tube opening 1414 can correspond to, and be in communication with, the first outer tube outlet 1425. The fourth inner tube opening 1415 can correspond to, and be in communication with, the second outer tube inlet 1424. The second outer tube outlet 1426 and the first outer tube inlet 1423 can be blocked and closed by the wall of the inner tube 141.

When the inner tube 141 is rotated to allow the second sliding block 1418 of the inner tube 141 to move to the second low position A2 (for example, see FIGS. 9 and 11) on the arc-sliding slot 1429 of the outer tube 142, the third inner tube opening 1414 can correspond to and be in communication with the first outer tube inlet 1423 and the fourth inner tube opening 1415 can correspond to and be in communication with the second outer tube outlet 1426. The first outer tube outlet 1425 and the second outer tube inlet 1424 can be blocked and closed by the wall of the inner tube 141.

In some exemplary embodiments, the correlation among the third inner tube opening 1414 and the fourth inner tube opening 1415 with the first outer tube outlet 1425 and the second outer tube inlet 1424, respectively, can be changed by rotating the inner tube 141, so as to achieve switching of air passages. For example, the inner tube 141 can be rotated so that the third inner tube opening 1414 and the fourth inner tube opening 1415 lines up with the first outer tube inlet 1423 and the second outer tube outlet 1426, respectively. A first air pump switch 1427 can be disposed outside of the arc sheet 1416 of the inner tube 141. Rotation of the inner tube 141 can allow the arc sheet 1416 to contact or separate from the first air pump switch 1427 to respectively switch on or off the power, power source or power to the first air pump.

As shown in FIGS. 2 and 4, the first air pump 13 can include an impeller cover 132 configured to be coupled to the housing 11. The receiving cavity 111 of the housing 11 can be divided into a motor cavity 1311 and an impeller cavity 1320 by the impeller cover 132. The impeller cover 132 can have an impeller cover inlet 1321, a first impeller cover outlet 1322, a second impeller cover outlet 1323, or any other desirable inlet or outlet. The impeller cover inlet 1321 can be in fluid communication with the first outer tube outlet 1425 and the second outer tube outlet 1426 via the first impeller cover outlet 1322 and the second impeller cover outlet 1323, respectively. The first and second impeller cover outlets 1322 and 1323 can correspond to, and be in fluid communication with, the first and second outer tube inlets 1423 and 1424, respectively. An impeller 133 can be disposed within the impeller cover 132. The rotation shaft 1312 of the motor 131 can pass through the impeller cover inlet 1321 to couple to the impeller 133. When the motor 131 operates, the fluid can be sucked into the impeller cover 132 via the impeller cover inlet 1321 and discharged from the first and second impeller cover outlets 1322 and 1323 upon being pressurized by the impeller 133.

As shown in FIGS. 2 and 4-6, the connection tube 22 can be disposed inside of the panel 16. A connection tube flange 223 with a diameter greater than the second vent 161 of the panel 16 can be disposed on the top of the connection tube 22. The upper surface of the connection tube flange 223 can be positioned adjacent to the inside of the panel 16 and be provided with two connection tube protruding stages 221 that pass through the second vent 161 to couple to the control switch 21. The switch vent 211 of the control switch 21 can correspond to, and be in fluid communication with, the second vent 161 via the vent tube (not shown) of the control switch 21. The lower end of the connection tube 22 can be sleeved on the upper end of the inner tube 141 of the air passage switch device 14. Particularly, a straight sliding slot 222 can be disposed on the inner wall of the connection tube 22, which can be configured to receive the first sliding block 1417 of the inner tube 141 and allow the first sliding block 1417 to axially slide therein.

As shown in FIGS. 2 and 3, the first valve 12 can be disposed on the bottom of the housing 11. A support 116 can be disposed at the first vent 113 and provided with a support hole 1161 at the center thereof. A valve rod 123 can be disposed within the support hole 1161 and can axially move along the support hole 1161. A first end 1231 and a second end 1232 of the valve rod 123 can, respectively, have a limiting element 121 and a valve plate 124 coupled thereto. The first end 1231 of the valve rod 123 can extend to the inner tube 141 of the air passage switch device 14 and abut against the spacer 1413 of the inner tube 141. A sealing ring 125 can encapsulate the outer periphery of the valve plate 124. A spring 122 can be sleeved on, or about, the valve rod 123 and disposed between the support 116 and the limiting element 121. A protection cover 126 can be disposed on the bottom of the housing 11 for protecting the valve plate 124.

Based on the above configuration, when no force is applied on the first valve 12, the first vent 113 can be sealed by the valve plate 124 and the sealing ring 125 by virtue of the elastic force of the spring 122, such that the first vent is closed. When the inner tube 141 of the air passage switch device 14 moves downward, the spacer 1413 of the inner tube 141 can make contact with the valve rod 123 and apply downward force thereto to drive the first valve 12 to open the first vent 113, thereby allowing the interior of the inflatable body 20 to be in fluid communication with the outer space of the inflatable body 20. When the first vent 113 is closed by the first valve 12, the internal space of the inflatable body 20 may not be in fluid communication with the outer space of the inflatable body 20.

Based on the above configuration, the control switch 21, the connection tube 22, the inner tube 141 of the air passage switch device 14, the first valve 12, and the first air pump switch 1427 together can form a linkage mechanism. Prior to inflation of the inflatable body 20 using the first air pump 13, the control switch 21 can rotate from the closed position to the inflation position. The control switch 21 can drive the connection tube 22 coupled thereto so as to drive the inner tube 141 of the air passage switch device 14 to axially move and radially rotate. The arc sheet 1416 of the inner tube 141 can trigger the first air pump switch 1427 to switch on the power, thereby initiating the first air pump 13. The second sliding block 1418 of the inner tube 141 can horizontally slide to the first low position A1 within the arc sliding slot 1429 of the outer tube 142. The inner tube 141 can axially move downward along the outer tube 142 and thus the first valve 12 can be opened by the spacer 1413, thereby opening the first vent 113. Meanwhile, the third inner tube opening 1414 can correspond to, and be in fluid communication with, the first outer tube outlet 1425 of the outer tube. The fourth inner tube opening 1415 can correspond to, and be in fluid communication with, the second outer tube inlet 1424. The second outer tube outlet 1426 and the first outer tube inlet 1423 can be blocked and closed by the wall of the inner tube 141. At this time, the air passage switch device 14 can be switched to the inflation air passage. As shown by the arrows in FIG. 4, fluid external to the inflatable body 20 flows into the impeller cavity 1320 via the switch vent 211 of the control switch 21, the connection tube 22, the third inner tube opening 1414 of the air passage switch device 14, the first outer tube outlet 1425, the motor cavity 1311, and the impeller cover inlet 1321. Upon being pressurized by the impeller 133, the fluid flows into the inflatable body 20 through the second impeller cover outlet 1323, the second outer tube inlet 1424, the fourth inner tube opening 1415, the second inner tube opening 1412 of the inner tube, and the first vent 113, thereby inflating the inflatable body 20.

Prior to deflating the inflatable body 20, the control switch 21 can be rotated from the closed position to the deflation position. The control switch 21 can drive the connection tube 22 coupled thereto to drive the inner tube 141 of the air passage switch device 14 to rotate. The arc sheet 1416 of the inner tube 141 can trigger the first air pump switch 1427 to switch on the power. When the first air pump 13 is initiated, the second sliding block 1418 can move to the second low position A2 on the arc sliding slot 1429 of the outer tube 142 (see FIGS. 9 and 11). The inner tube 141 can axially move downward within the outer tube 142. The first valve 12 can be opened by the spacer 1413, thereby opening the first vent 113. The third inner tube opening 1414 can correspond to, and be in communication with, the first outer tube inlet 1423. The fourth inner tube opening 1415 can correspond to, and be in communication with, the second outer tube outlet 1426. The first outer tube outlet 1425 and the second outer tube inlet 1424 can be blocked and closed by the wall of the inner tube 141. At this time, the air passage switch device 14 can be switched to the deflation air passage. As shown by the arrows in FIG. 5, internal fluid of the inflatable body 20 flows from the first vent 113 to the impeller cavity 1320 via the second inner tube opening 1412 of the inner tube 141, the fourth inner tube opening 1415, the second outer tube outlet 1426, the motor cavity 1311 and the impeller cover inlet 1321. Upon being pressurized by the impeller 133, the fluid can be discharged from the switch vent 211 to the outer space of the inflatable body 20 via the first impeller cover outlet 1322, the first outer tube inlet 1423 of the outer tube 142, the first inner tube opening 1411 of the inner tube 141, the connection tube 22 and the second vent 161.

Upon completion of inflating or deflating the inflatable body 20, the control switch 21 can be rotated to the closed position. The control switch 21 can drive the connection tube 22 coupled thereto to drive the inner tube 141 of the air passage switch device 14 to rotate together. The arc sheet 1416 of the inner tube 141 can trigger the first air pump switch 1427 to switch off the power. The first air pump 13 can be secured, and the second sliding block 1418 of the inner tube 141 can slide horizontally to the middle high point B within the arc sliding slot 1429 of the outer tube 142 (as shown in FIG. 11). Thereafter, the inner tube 141 can move axially upward within the outer tube 142. The spacer 1413 of the inner tube 141 may stop applying force to the valve rod 123 of the first valve 12. The valve plate 124 can cover the first vent 113 under the elastic force of the spring 122 and thus the first vent 113 can be closed. At this time, the air passage switch device 14 can be switched to the closed air passage. As shown in FIGS. 5 and 10, the internal space of the inflatable body 20 may then not be in fluid communication with an external space thereof. The fluid of the present disclosure is not limited to air and can be any other suitable type of gas or fluid.

As shown in FIGS. 2 and 3, the second air pump 15 can be mounted to a side wall of the housing 11 by using a mounting member 157, the second air pump 15 able to supplementarily inflate the inflatable body 20 after the first air pump 13 inflates the inflatable body 20. A shock absorber 156 can be disposed between the second air pump 15 and the mounting member 157 and configured to reduce detection by a user of vibration from operation of the second air pump 15. In this exemplary embodiment, the second air pump 15 can be a silent diaphragm pump, but the second air pump 15 is not limited thereto. The second air pump 15 can be any other suitable pump. The second air pump 15 can define an air pump inlet (not shown), an air pump outlet 151 that is coupled to an outlet connection tube 152 with the end coupled to a second valve 153 (e.g., a one-way valve), or any other desirable inlet or outlet. The second valve 153 can be mounted to a supplementary opening fixing member 155 by a valve connection tube 154 (e.g., a one-way valve connection tube). The supplementary opening fixing member 155 can be coupled to, and be in fluid communication with, a supplementary opening, such as a supplementary air vent 115. The second valve 153 may allow the fluid to flow into the internal space of the inflatable body 20 but may not allow the fluid to flow out from the internal space of the inflatable body 20. When the second air pump 15 supplementarily inflates the inflatable body 20, fluid external from the inflatable body 20 can flow through the panel vent 225, the receiving cavity 111, the air pump inlet, the air pump outlet 151, the outlet connection tube 152, the second valve 153, the valve connection tube 154, the supplementary opening fixing member 155, and the supplementary air vent 115 and flow into the internal space of the inflatable body 20.

The air pressure sensor 24 can be in fluid communication with the internal space of the inflatable body 20 via a pressure detection tube 241, pressure detection opening fixing member 242 and a detection opening, such as the pressure detection vent 114 to detect the inner pressure of the inflatable body 20, as shown in FIG. 2.

The first and second prompting devices 17 and 18 can be electrically coupled to the control device 19. The first prompting device 17 can output a power switching-on signal, for example, when the electric air pump system 1 is connected with the power (not shown), or a power source. The first prompting device 17 can output a first indication signal when the inner pressure of the inflatable body 20 is less than or equal to a first pressure threshold. The second prompting device 18 can output a second indication signal when the second air pump 15 inflates the inflatable body 20. For example, the second prompting device 18 can output the second indication signal when the inner pressure of the inflatable body 20 is greater than or equal to a third air pressure threshold after the first air pump 13 has turned off.

After the first air pump 13 inflates the inflatable body 20 to the first threshold air pressure (e.g., 240mm$H_2O$), the first prompting device 17 can output the first indication signal until the inner pressure of the inflatable body 20 sensed by the air pressure sensor 24 is reduced to a second threshold air pressure. At this time, the first prompting device 17 may stop outputting the first indication signal. When the inner pressure is reduced to below the second threshold air pressure (e.g., 200mm$H_2O$) but at or above a third threshold air pressure (e.g., 150mm$H_2O$), the second air pump 15 can be initiated to supplementarily inflate the inflatable body 20. The second prompting device 18 can output the second indication signal until the inner pressure of the inflatable body 20 sensed by the air pressure sensor 24 arrives at the first threshold air pressure. At this time, the second air pump 15 may stop inflating the inflatable body 20 and the second prompting device 18 may stop outputting the second indication signal, and the first prompting device 17 can output the first indication signal. When the inner pressure is reduced to below the third threshold air pressure (e.g., 150mm$H_2O$), as sensed by the air pressure sensor 24, the second air pump 15 may not be initiated and thus the inflatable body 20 may not supplementary inflate. This may occur when the first air pump 13 accidentally, or erroneously, stops inflating the inflatable body 20. Any of the first, second, or third air pressure thresholds may be any predetermined air pressure thresholds, changeable air pressure thresholds, or any other desired thresholds.

In some embodiments, the first and second air pumps 13, 15 can be activated at the same time or different times. For example, the first air pump 13 can be activated and pump air within the inflatable body 20. The first air pump 13 can then deactivate and stop pumping air. At a different time after the first air pump 13 has been deactivated, the second air pump 15 can be activated and pump air within the inflatable body 20.

In some exemplary embodiments, the first prompting device 17 can be a light-emitting device that emits light with, or having, a first color, such as a first LED lamp 23 that can emit green light. The second prompting device 18 can be a light-emitting device that emits light with, or having, a second color, such as a second LED lamp 23 that emits blue light. The first and second LED lamps can be at least in partially disposed in the first and second display holes 171 and 181 on the panel 16. The power switching-on signal can be green light intermittently emitted by the first LED lamp 23 during the predetermined period of time. The first indication signal can be green light continuously emitted by the first LED lamp 23 during the predetermined period of time. The second indication signal can be blue light intermittently emitted by the second LED lamp 23 during the predetermined period of time, or blue light continuously emitted during the predetermined period of time. In alternative embodiments, the first and second prompting devices 17 and 18 can be light-emitting devices emitting light with other colors, as long as the power switching-on signal, the first and second indication signals can be distinguished by user. Any of the first, second, or third periods of time may be predetermined periods of time, changeable periods of time, or any other desirable periods of time.

In some exemplary embodiments, when the first air pump 13 inflates the inflatable body 20 for at least a predetermined period of time (e.g., 10 minutes) and the inner pressure of the inflatable body 20 sensed by the air pressure sensor 24 is lower than the first predetermined air pressure threshold, at least one of the first and second prompting devices 17 and 18 can output a third indication signal and meanwhile, the control device 19 can instruct the first air pump 13 to stop operating in order to prevent the motor 131 of the first air pump 13 from continuously heating.

In some exemplary embodiments, when the first air pump 13 inflates the inflatable body 20 for at least a predetermined period of time (e.g., 10 minutes), and the inner pressure of the inflatable body 20 sensed by the air pressure sensor 24 is less than the first air pressure thresholds, any of the first prompting device 17, second prompting device 18, or a third prompting device 109 may output a third indication signal. At this time, the control device 19 can instruct the first air pump 13 to stop operating.

In some exemplary embodiments, at least one of the first, second, and third prompting devices 17, 18, 109 can be disposed on the panel 16. The control device 19 can comprise a control circuit board 191 electrically coupled to the first, second and third prompting devices 17, 18, 109 and the panel 16 defines a display hole in which the first, second and third prompting devices 17, 18, 109 can be at least in part disposed.

In some exemplary embodiments, the electric air pump system 1 may further comprise a third prompting device 109 that can be a sound-generating device electrically coupled to the control device 19. The sound-generating device can be configured to output a sound signal for initiating the second air pump 15 when the second air pump 15 is initiated to inflate the inflatable body 20 and to output a sound signal for stopping the second air pump 15 when the air pressure sensed by the air pressure sensor 24 arrives at the first predetermined air pressure threshold. The second air pump 15 can be further configured to output a power switching-on sound signal when the electric air pump system 1 is connected with the power and to output a fault sound signal when the first air pump 13 inflates the inflatable body 20 for at least a predetermined period of time and the inner pressure of the inflatable body 20 as sensed by the air pressure sensor 24 is less than the first air pressure threshold. The sound-generating device can be a buzzer or any other suitable device that is able to generate sound.

In some exemplary embodiments, the electric air pump system 1 can detect the inner pressure of the inflatable body 20 in real time and send indication signals to user in virtue of the prompting devices in real time. As such, the user can know the inner pressure of the inflatable body 20. In addition, the electric air pump system 1 can inform the user that the electric air pump system 1 or the inflatable body 20 has a fault.

In some exemplary embodiments as described herein, the electric air pump system 1 further comprises a third prompting device 109, can comprise a sound-generating device electrically coupled to the control device 19, wherein the sound-generating device can be configured to output a sound signal for initiating the second air pump 15 when the second air pump 15 is initiated to inflate the inflatable body 20 and output the sound signal for stopping the second air pump 15 when the air pressure sensed by the air pressure sensor 24 arrives at the first predetermined air pressure threshold and the second air pump 15 stops operating. The third prompting device 109 can be configured to output a sound signal if the second air pump 15 is initiated to inflate the inflatable body 20 and the air pressure sensed by the air pressure sensor 24 is less than the first predetermined air pressure threshold within a second period of time and the second air pump 15 stops operating.

In some exemplary embodiments, the panel 16 can further comprise a third display hole in which the third prompting device 109 can be at least in part disposed within the electric air pump system 1.

In some exemplary embodiments, the panel 16 can further comprise a hole 110, such as a plurality of holes. The third prompting device 109 can output a sound that can travel through the hole 110.

In the present exemplary embodiment, the control device 19 comprises a control circuit board 191 and a control device-mounting member 192 that can be configured to fix the control circuit board 191 within the housing 11. The first, second, and third prompting devices 17, 18, 109 can be electrically coupled to the control circuit board 191.

In some exemplary embodiments, a lamp 23 and a lamp switch 25, which can be electrically coupled to the control circuit board 191, are disposed on the panel 16. The lamp switch 25 can be activated to turn on the lamp 23 and the lamp 23 can be turned off when the lamp switch 25 is disconnected with, or from, the power source. As such, a user can turn on or off the lamp 23 as needed, for example, in dark environment.

The electric air pump system 1 of the present disclosure can have a prompting device or any other desirable device used by a user to easily judging the inner pressure of the inflatable body 20 and thus, for determining whether the electric air pump system 1 or inflatable body 20 has malfunctioned.

Although the present disclosure illustrates certain embodiments, various modifications can be made without departing from the spirit of the present disclosure. All of the modifications come within the scope of the present disclosure.

The above detailed description merely sets forth exemplary embodiments of the present disclosure. It is obvious for those skilled in the art that various modifications can be made according to the teachings of the present disclosure and various equivalents can be utilized to practice the present disclosure. Therefore, the particular embodiments, as set forth above to describe the present disclosure, are not intended to limit the scope of the present disclosure, unless otherwise clearly stated. Therefore, various modifications, changes, replacements are within the scope of the present disclosure. The electric air pump can be properly operated without specific elements or optional elements as disclosed herein. Unless otherwise clearly stated, the terms in the claims have the common meaning in the art.

In addition, the amount of the elements in the claims is one or at least one. Unless otherwise clearly stated, if the terms in the present disclosure are inconsistent with the terms in other reference documents, then the meanings of the terms as defined in the present disclosure should be used.

While the disclosure has been described in connection with certain embodiments, it is to be understood that the disclosure is not to be limited to the disclosed embodiments but, on the contrary, is intended to cover various modifications and equivalent arrangements included within the scope of the appended claims, which scope is to be accorded the broadest interpretation so as to encompass all such modifications and equivalent structures as is permitted under the law.

What is claimed is:

1. An electric air pump system, comprising:

a housing defining a receiving cavity, a housing opening and a first vent in fluid communication with an inflatable body;

a first valve for opening and closing the first vent;

a first air pump for inflating and deflating the inflatable body, wherein the first air pump is configured to inflate the inflatable body to a first air pressure threshold;

a second air pump for inflating the inflatable body after the inflatable body is inflated by the first air pump, wherein the second air pump is configured to inflate the inflatable body when an inner pressure of the inflatable body is less than or equal to a second air pressure threshold and greater than or equal to a third air pressure threshold;

an air pressure sensor in fluid communication with the inflatable body and configured to detect the inner pressure;

a first prompting device and a second prompting device; and a control device electrically coupled to the first air pump, the second air pump, the air pressure sensor, and the first and second prompting devices;

wherein:

the first prompting device is configured to indicate that the inner pressure is less than or equal to the first air pressure threshold and greater than the second air pressure threshold; and the second prompting device is configured to indicate that the second air pump is inflating the inflatable body.

2. The electric air pump system of claim 1, further comprising:

an air passage switch device coupled to the first air pump and configured to switch between an inflation air passage, a deflation air passage, and a closed air passage;

wherein the air passage switch device is further configured to control the first valve to permit or prevent fluid flow through the first vent.

3. The electric air pump system of claim 2, wherein the air passage switch device further comprises:

an inner tube configured to move axially in a first direction or in a second direction opposite from the first direction within an outer tube to permit or prevent fluid flow through the first vent; and an arc sheet coupled to the inner tube and configured to trigger a first air pump switch to switch a power source on or off.

4. The electric air pump system of claim 1, wherein the first prompting device is further configured to output a power switching-on signal when the electric air pump system is connected with a power source.

5. The electric air pump system of claim 1, wherein after the first air pump stops inflation:

if the inner pressure is less than or equal to the second air pressure threshold and greater than or equal to the third air pressure threshold, the second air pump inflates the inflatable body and the second prompting device indicates that the second air pump is inflating the inflatable body; and if the inner pressure reaches the first air pressure threshold, the second air pump stops inflating the inflatable body, and the second prompting device stops indicating.

6. The electric air pump system of claim 1, wherein after the first air pump stops inflation, if the inner pressure falls below the third air pressure threshold, the second air pump stops inflating the inflatable body and the second prompting device stops indicating.

7. The electric air pump system of claim 1, wherein when the first air pump inflates the inflatable body for at least a first period of time and the inner pressure is less than the first air pressure threshold, at least one of the first prompting device, the second prompting device, and a third prompting device outputs an indication that the first time period has elapsed.

8. The electric air pump system of claim 1, wherein when the first air pump inflates the inflatable body for at least a period of time and the inner pressure sensed by the air pressure sensor is less than the first air pressure threshold, the control device instructs the first air pump to stop operation.

9. The electric air pump system of claim 1, wherein the first air pressure threshold is 240mm$H_2O$, the second air pressure threshold is 200mm$H_2O$, and the third air pressure threshold is 150mm$H_2O$.

10. The electric air pump system of claim 1, wherein the first prompting device comprises a first light-emitting device that emits light having a first color.

11. The electric air pump system of claim 10, wherein the second prompting device comprises a second light-emitting device that emits light having a second color.

12. The electric air pump system of claim 1, wherein the first prompting device continuously or intermittently emits for a period of time.

13. The electric air pump system of claim 1, wherein the second prompting device continuously or intermittently emits for a period of time.

14. The electric air pump system of claim 1, further comprising a third prompting device comprising a sound-generating device electrically coupled to the control device, wherein the sound-generating device is configured to output a first sound signal indicating that the second air pump is initiated to inflate the inflatable body and output a second sound signal indicating that the air pressure has reached the first air pressure threshold and the second air pump has stopped operating.

15. The electric air pump system of claim 14, wherein the sound-generating device is further configured to:

output a power connection sound signal indicating that the electric air pump system is connected with a power source; and output a fault sound signal indicating that a period of time has elapsed and the inner pressure is less than the first air pressure threshold.

16. The electric air pump system of claim 1, further comprising:

a panel enclosing an opening in the housing and defining a second vent;

wherein:

the control device comprises a control circuit board electrically coupled to the first prompting device, the second prompting device, and a third prompting device; and the panel defines a plurality of display holes through which the first, second, and third prompting devices are disposed.

17. The electric air pump system of claim 16, further comprising:

a lamp and a lamp switch electrically coupled to the control circuit board and located on the panel, wherein the lamp switch is configured to turn on the lamp.

18. The electric air pump system of claim 1, further comprising:

a shock absorber disposed between the second air pump and a mounting member, wherein the shock absorber reduces vibration from operation of the second air pump otherwise reaching the inflatable body.

19. An electric air pump system, comprising:

an inflatable body;

a first air pump configured to inflate the inflatable body to a first air pressure threshold;

a first prompting device configured to output a first signal when an inner air pressure of the inflatable body is greater than a second air pressure threshold;

a second air pump configured to inflate the inflatable body to the first air pressure threshold if the inner pressure is between the second air pressure threshold and a third air pressure threshold after the inflatable body has previously reached the first air pressure threshold;

a second prompting device configured to output a second signal when the second air pump inflates the inflatable body;

a third prompting device configured to output a default signal; and a control device coupled to at least the first air pump and the third prompting device and configured to:

turn off the first air pump and output the default signal if the first air pump does not inflate the inflatable body to the first air threshold within a period of time.

* * * * *